US008240947B2

(12) United States Patent
Gelfand et al.

(10) Patent No.: US 8,240,947 B2
(45) Date of Patent: Aug. 14, 2012

(54) VEHICLE BARRIER WITH RELEASE MECHANISM

(75) Inventors: Matthew A. Gelfand, Brentwood, TN (US); Eddie N. Barnes, Madison, TN (US); Ronald Lee Childers, Jr., Madison, TN (US)

(73) Assignee: Smith & Wesson Security Solutions, Inc., Franklin, TN (US)

( * ) Notice: Subject to any disclaimer, the term of this patent is extended or adjusted under 35 U.S.C. 154(b) by 268 days.

(21) Appl. No.: 12/704,144

(22) Filed: Feb. 11, 2010

(65) Prior Publication Data

US 2010/0202829 A1 Aug. 12, 2010

Related U.S. Application Data

(60) Provisional application No. 61/207,441, filed on Feb. 11, 2009.

(51) Int. Cl.
*E01F 13/04* (2006.01)

(52) U.S. Cl. ..... 404/6; 404/10; 49/9; 49/34; 49/49

(58) Field of Classification Search ..... 49/9, 34, 49/49; 404/6, 10
See application file for complete search history.

(56) References Cited

U.S. PATENT DOCUMENTS

| | | | | |
|---|---|---|---|---|
| 2,675,197 | A | 4/1954 | Hospers | |
| 4,456,205 | A * | 6/1984 | Alavoine et al. | 244/110 C |
| 4,824,282 | A * | 4/1989 | Waldecker | 404/6 |
| 5,310,277 | A | 5/1994 | Uotila | |
| 5,605,414 | A | 2/1997 | Fuller | |
| 5,762,443 | A | 6/1998 | Gelfand | |
| 6,843,613 | B2 | 1/2005 | Gelfand et al. | |
| 6,896,443 | B1 * | 5/2005 | Ousterhout et al. | 404/6 |
| 7,083,357 | B2 * | 8/2006 | Lamore | 404/6 |
| 7,140,802 | B2 * | 11/2006 | Lamore | 404/6 |
| 7,195,419 | B2 * | 3/2007 | Gelfand | 404/6 |
| 7,210,873 | B2 | 5/2007 | Gelfand | |
| 7,374,362 | B1 * | 5/2008 | Metzger | 404/6 |

(Continued)

FOREIGN PATENT DOCUMENTS

WO WO 92-02688 A1 2/1992

OTHER PUBLICATIONS

International Search Report and Written Opinion for International Application No. PCT/US2010/023905 dated Apr. 14, 2010.

(Continued)

*Primary Examiner* — Gary S Hartmann

(57) ABSTRACT

A barrier for arresting a vehicle. The barrier includes a net spanning an area through which the vehicle may pass, an anchor coupled to the net, a support arm arranged on one side of the area through which the vehicle may pass, a raising/lowering mechanism for raising and lowering the support arm, and a release mechanism arranged on the support arm, the release mechanism having an upper and a lower protrusion forming an interior space to accommodate a member coupled to the net, and the member and the release mechanism become uncoupled upon application to the net of at least a predetermined threshold force.

11 Claims, 21 Drawing Sheets

U.S. PATENT DOCUMENTS

| | | | | |
|---|---|---|---|---|
| 7,377,716 | B2 * | 5/2008 | Gelfand | 404/6 |
| 7,441,983 | B2 * | 10/2008 | Gelfand | 404/6 |
| 7,690,859 | B2 * | 4/2010 | Metzger | 404/6 |
| 7,785,031 | B2 * | 8/2010 | Vellozzi et al. | 404/6 |
| 8,002,492 | B2 * | 8/2011 | Gelfand | 404/6 |
| 2002/0085880 | A1 * | 7/2002 | Schneider et al. | 404/6 |
| 2007/0237577 | A1 | 10/2007 | Gelfand | |
| 2007/0258761 | A1 | 11/2007 | Orner, Jr. et al. | |

OTHER PUBLICATIONS

Gary Ell, "Rig on the Run: ESCO-ZA Featured on Discovery Channel's Hit Show 'Smash Lab'", at http://www.esco.zodiacaerospace.com/news/2008/ESCO-Featured-on-Discovery-Channel-%20Hit-Show.php, Sep. 10, 2008.

Jan. 21, 2010 International Search Report and Written Opinion for PCT/US2009/065418.

* cited by examiner

VEHICLE BARRIER WITH RELEASE MECHANISM

CROSS-REFERENCE TO RELATED APPLICATIONS

This application claims the benefit of Provisional U.S. Patent Application No. 61/207,441, filed Feb. 11, 2009; the contents of which is hereby incorporated by reference.

BACKGROUND

The invention of the present disclosure relates to a vehicle barrier. More particularly, the invention of the present disclosure relates to a vehicle barrier that may be arranged across an area through which a vehicle may pass. When in a raised position, the vehicle barrier may engage and stop an approaching vehicle. When in a lowered position, the vehicle barrier may allow vehicles to pass. It may be desirable to have such a vehicle barrier that may be portable, modular, and easily assembled and disassembled. To achieve those goals, it may be desirable to have a vehicle barrier with a net; one or more raising/lowering posts; and release mechanisms to allow detachable connection of the net to the raising/lowering posts.

SUMMARY OF THE DISCLOSURE

A barrier for arresting a vehicle. The barrier includes a net spanning an area through which the vehicle may pass, an anchor coupled to the net, a support arm arranged on one side of the area through which the vehicle may pass, a raising/lowering mechanism for raising and lowering the support arm, and a release mechanism arranged on the support arm, the release mechanism having an upper and a lower protrusion forming an interior space to accommodate a member coupled to the net, and the member and the release mechanism become uncoupled upon application to the net of at least a predetermined threshold force.

DETAILED DESCRIPTION

Figure 1A:
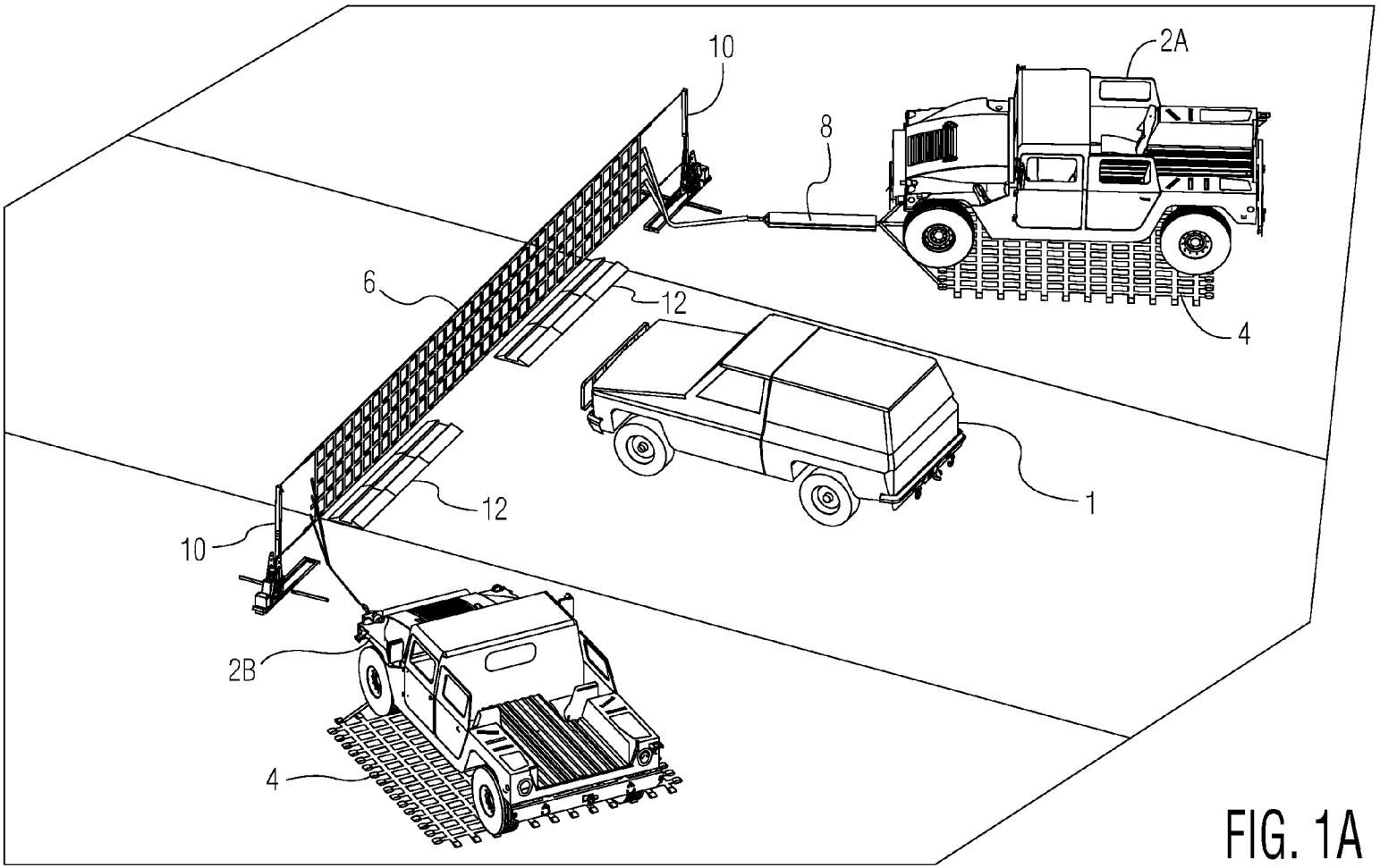
FIGS. 1A and 1B show perspectives view of the barrier according to an aspect of the present disclosure in a raised position.

The barrier of the present disclosure may be described in detail using the accompanying drawings, wherein like reference numerals represent identical or corresponding parts throughout the several views.

FIG. 1A shows friendly vehicles 2A and 2B parked atop anchor pads 4 on either side of an area through which a vehicle may pass. Vehicles 2A and 2B and/or anchor pads 4 may be coupled to energy absorbers 8 (one energy absorber 8 is visually occluded by friendly vehicle 2B in FIG. 1). Energy absorbers 8 may be coupled to net 6, shown here in a raised position. Net 6 may be supported, that is, raised and lowered, by pillar 10. Ramp 12 may allow vehicles to pass over net 6 when net 6 is in a lowered position. In one aspect, energy absorbers 8 may include a length of synthetic material that is woven together and that absorbs or dissipates energy when pulled apart.

Figure 1B:
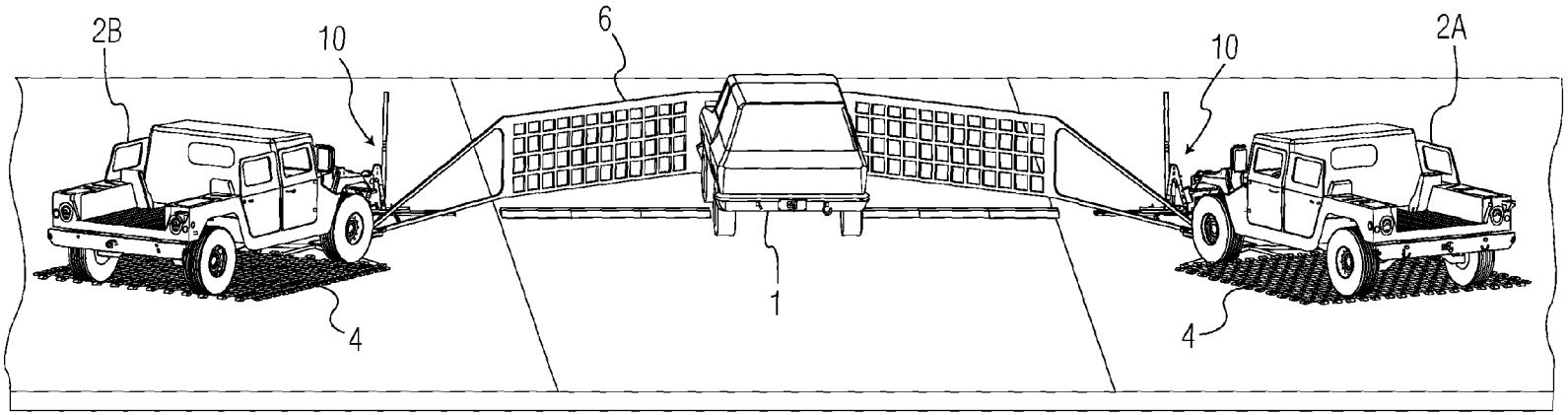

As shown in FIG. 1B and described in more detail below, in one aspect of the system of the present disclosure, when net 6 is in a raised position, vehicle 1 may strike and impart force on net 6. Upon application of a predetermined threshold force from vehicle 1, net 6 may uncouple from pillar 10. As impact by vehicle 1 continues, net 6 may apply force to energy absorbers 8. Energy absorbers 8 may be coupled to anchors, such as anchor pads 4. When energy absorbers 8 are woven material, the force from impact by vehicle 1 may rip apart woven material in energy absorber 8, thereby absorbing or dissipating energy and causing vehicle 1 to decelerate.

Figure 2A:
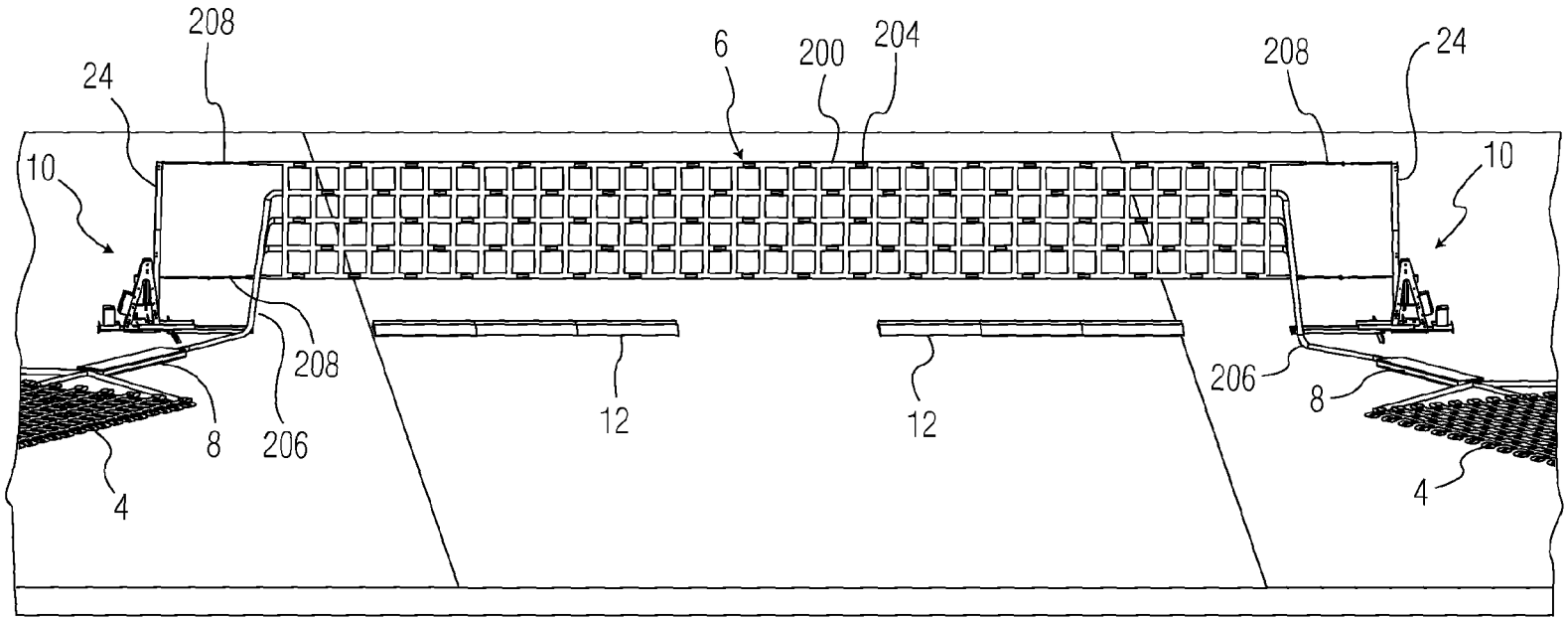
FIGS. 2A and 2B show a front view of the barrier according to an aspect of the present disclosure in raised and lowered positions.
Figure 2B:
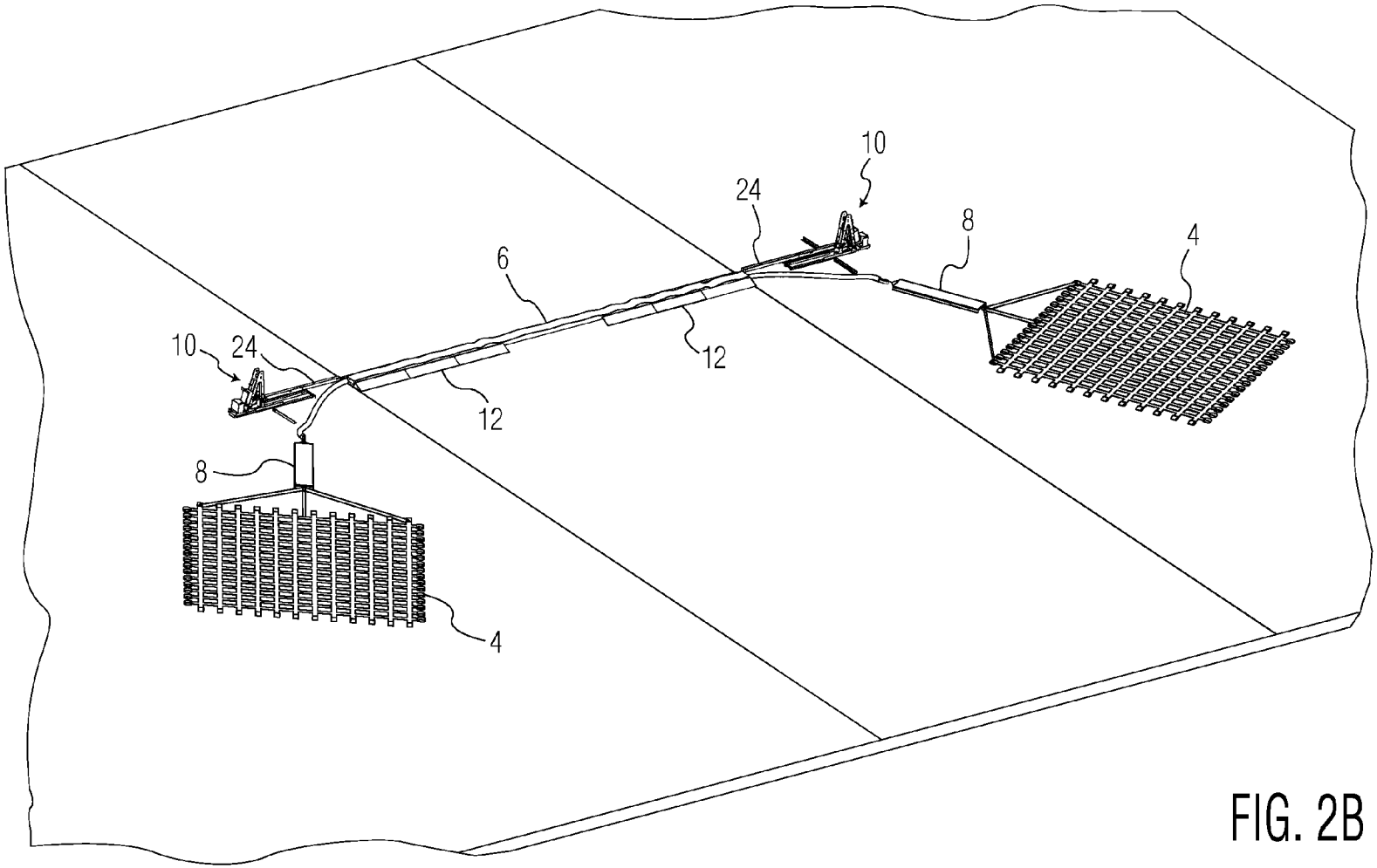

FIGS. 2A and 2B show a barrier with net 6 in upright and lowered positions, respectively. Net 6 may include horizontal members 200 and vertical members 204 that may be coupled to energy absorber connector 206 and pillar connector 208. In one aspect, net 6 may be woven multi-ply synthetic material, while energy absorber connector 206 and pillar connector 208 may be woven synthetic material or woven metal cable.

In FIG. 2A, lifting arms 24 of pillars 10 are in a raised, vertical or substantially vertical position. Lifting arms 24 may be metal, such as steel or aluminum, and may be coated or painted to protect from damage. In FIG. 2B, lifting arms 24 are in a lowered, horizontal or substantially horizontal position. In one aspect, lifting arms 24 may be lowered toward one another in a direction across an area through which a vehicle may pass. Pillars 10 and lifting arms 24 may be arranged such that when lowered, lifting arms 24 do not extend into an area through which a vehicle may pass and may therefore avoid contact with or unnecessary disruption by a passing vehicle. As shown in FIG. 2B, ramp 12 may accommodate net 6 and allow vehicles to pass over net 6 when in a lowered position. In one aspect, ramp 12 may be durable plastic.

Figure 3:
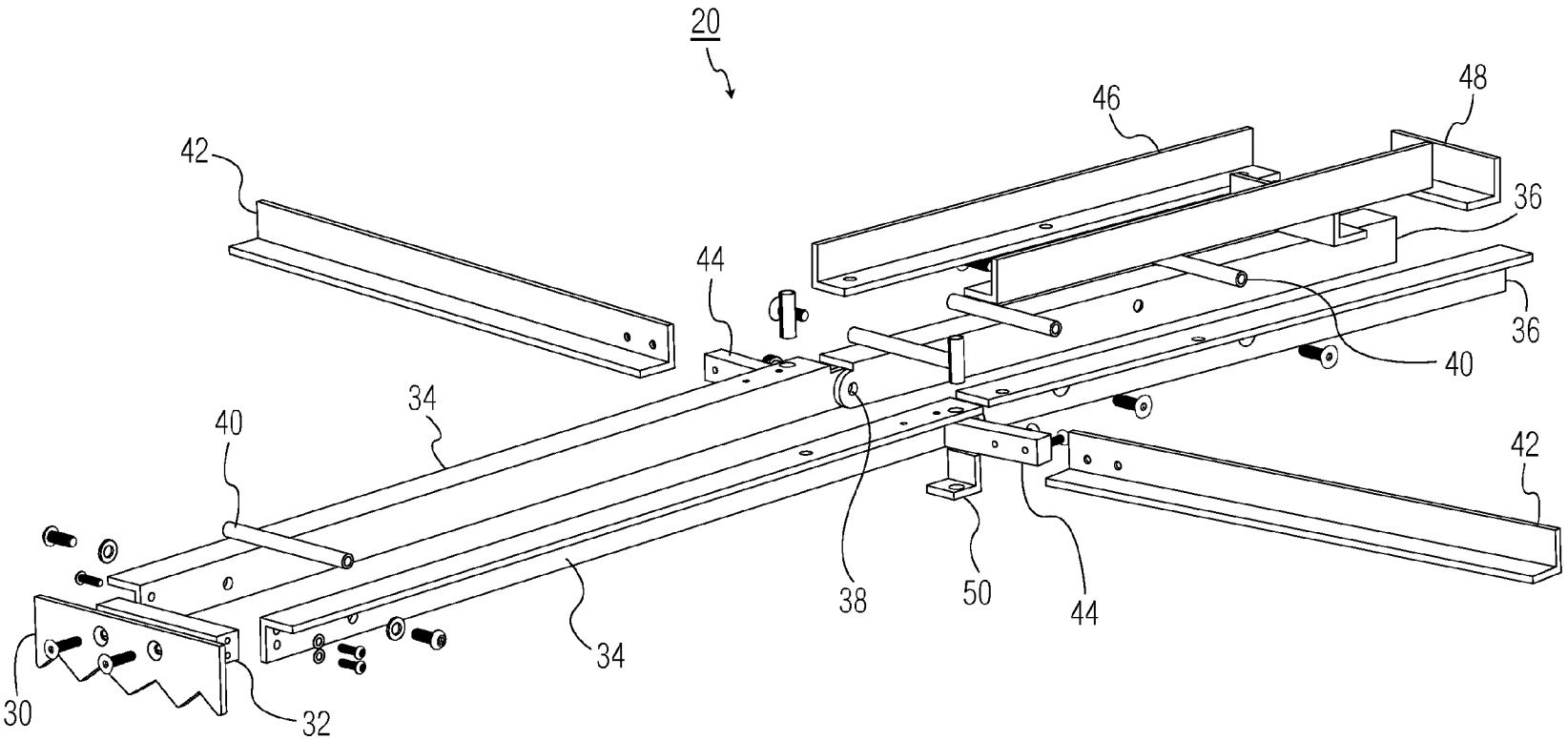
FIG. 3 shows an exploded view of a base of the barrier according to an aspect of the present disclosure.

FIG. 3 shows an exploded view of base 20 of pillar 10, including rake 30 connected to rake mount bar 32, which may connect to inner members 34, which may connect to outer members 36 at point 38. In one aspect, inner members 34 and outer members 36 may be pivotably connected and point 38 may include a joint (not shown). In one aspect, rake 30 may at least partially penetrate the ground, thereby helping prevent base 20 from moving once the barrier is in place. Spacer bars 40 may couple inner members 34 and outer members 36 and may provide rigidity. Spacer bars 40 may couple base 20 to lifting mechanism 22 (shown in FIGS. 4A and 4B). Lateral members 42 may provide stability and may be coupled to inner members 34 via pivots 44. Mounting braces 46 may accommodate battery 118 (shown in FIG. 12) and counterweight 120 (shown in FIG. 12). Stand 50 may provide additional support. In one aspect, portions of base 20 may disassemble and other portions may be collapsible for increased ease of transport or storage. Some or all of base 20 may be made of metal, such as steel or aluminum, and may be coated or painted to protect from damage.

Figure 4A:
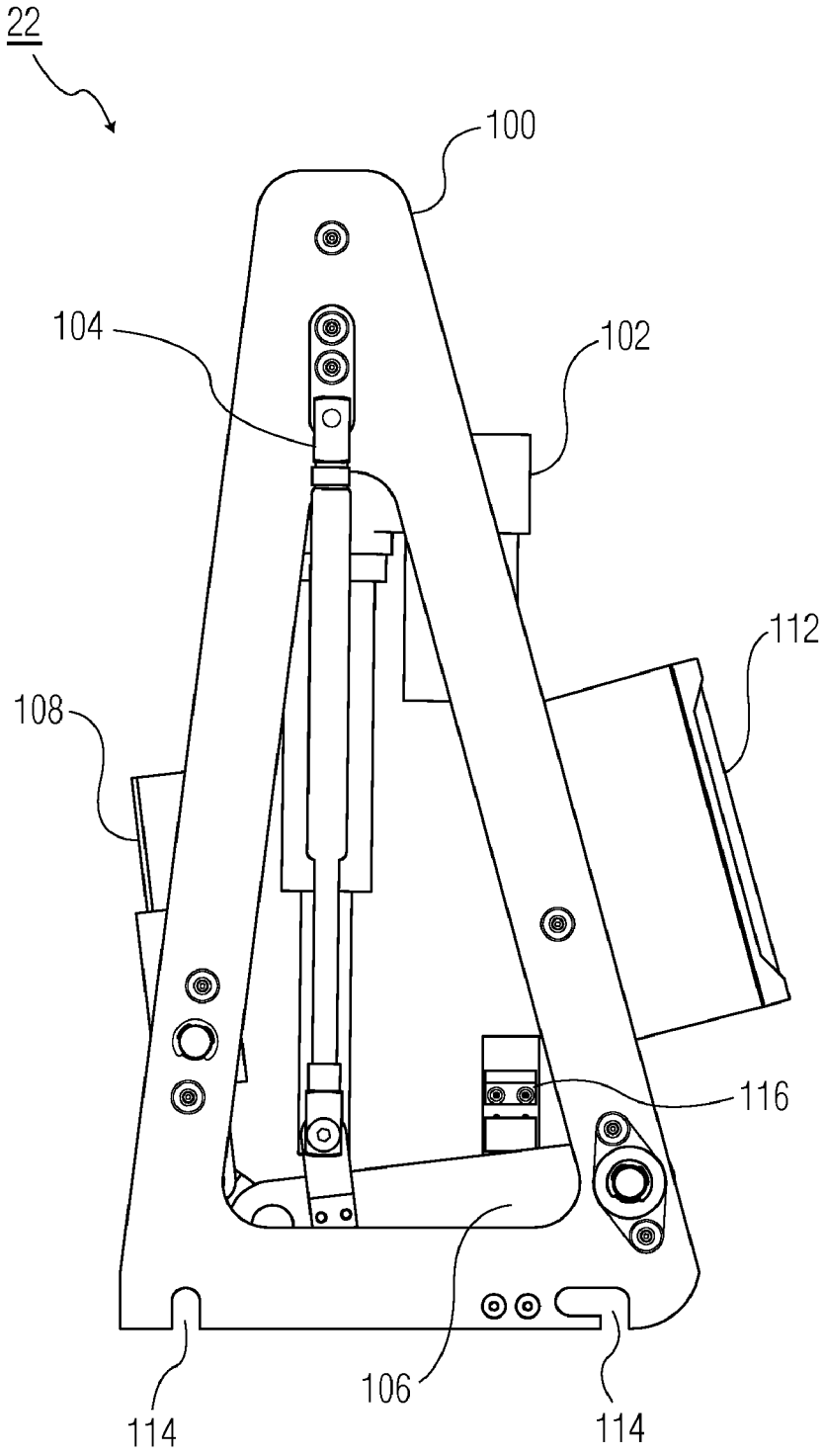
FIGS. 4A-4C show side, perspective, and exploded perspective views of lifting mechanism according to an aspect of the present disclosure.
Figure 4B:
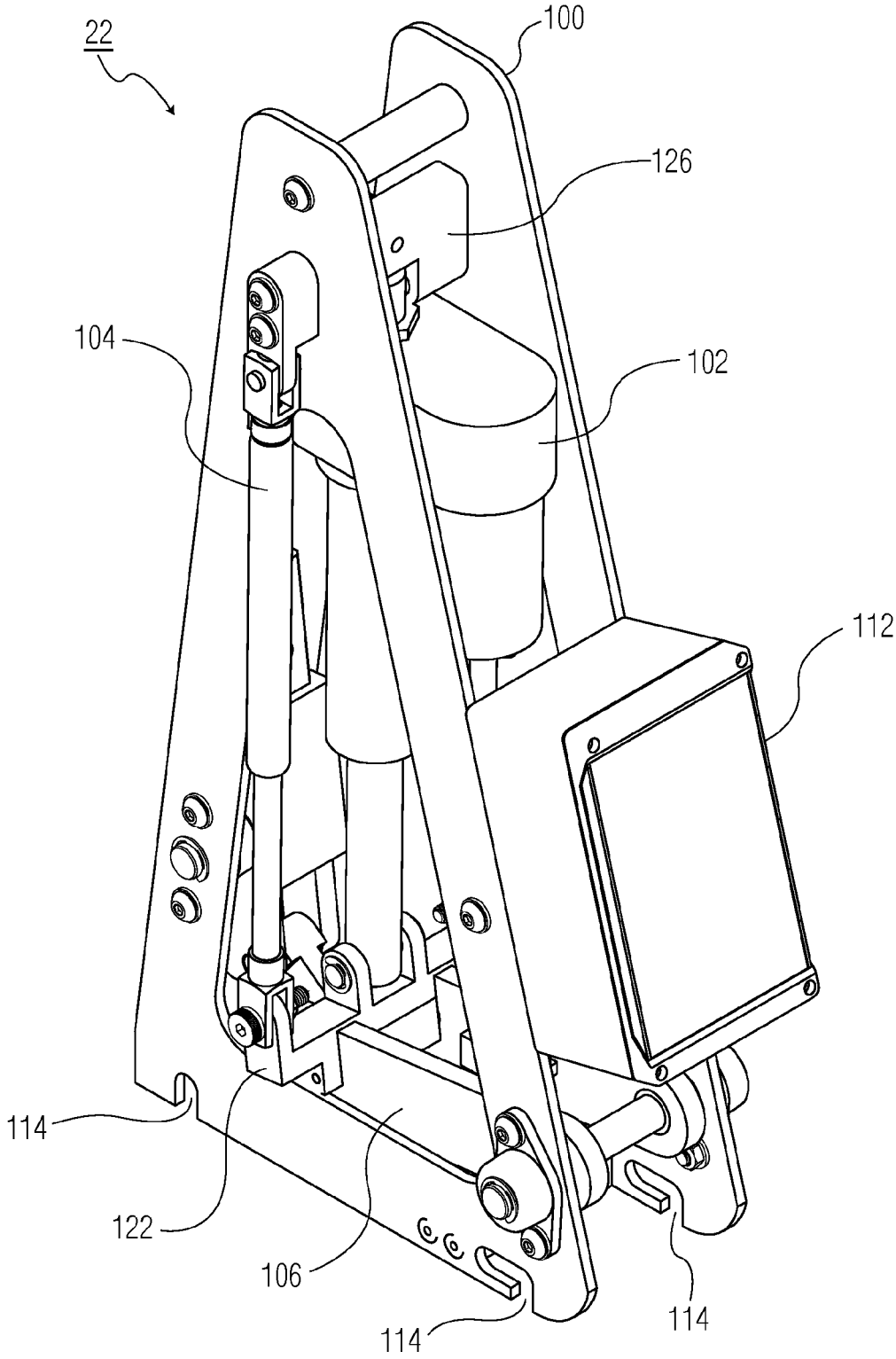
Figure 4C:
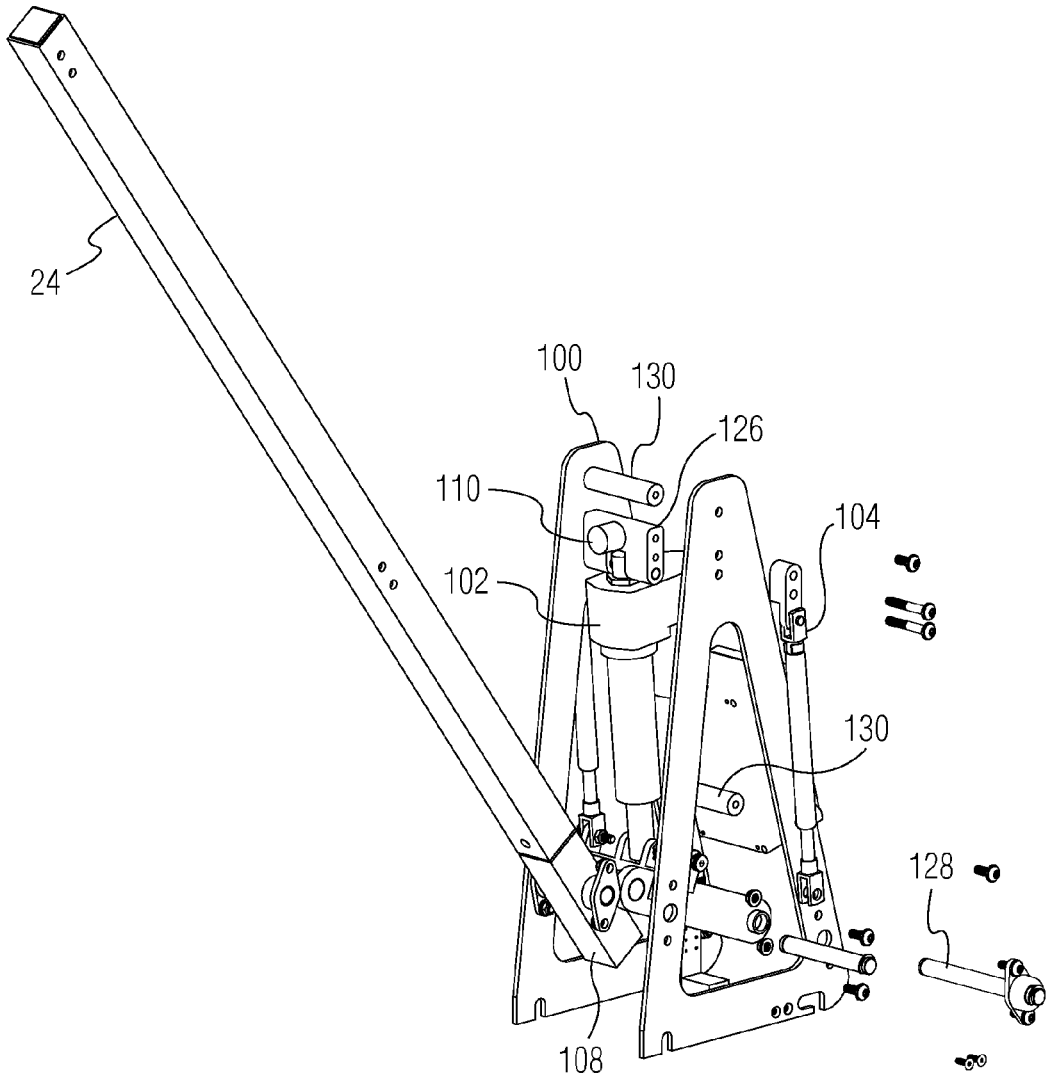

FIGS. 4A and 4B show lifting mechanism 22 including frame 100 with actuator 102 and spring 104 coupled thereto via support 126. End portions of actuator 102 and spring 104 may be coupled to lever 106 via clevis 122. In an aspect of the invention shown in the figures, lifting mechanism 22 is shown having two parallel levers 106 and two parallel springs 104. Spring 104 may apply downward pressure on lever 106 and assist actuator 102 when raising lifting arm 24. One end of lever 106 may be pivotably mechanically coupled to frame 100 via axle 128 (shown in FIG. 4C). Another end of lever 106 may be pivotably mechanically coupled to link bar 108, which may be coupled to lifting arm 24 (shown in FIG. 4C). Mounting holes 114 may allow frame 100 to couple to base 20. As shown in FIG. 4C, stopper 110 may prevent lifting arm 24 from contacting frame 100 during raising. Spacers 130 may be placed between frames 100 for structural rigidity.

Some or all of lifting mechanism 22 may be made of metal, such as steel or aluminum, and may be coated or painted to protect from damage. In one aspect, actuator 102 may be a screw drive or ball screw drive actuator, and spring 104 may be a push-type gas spring.

Figure 5A:
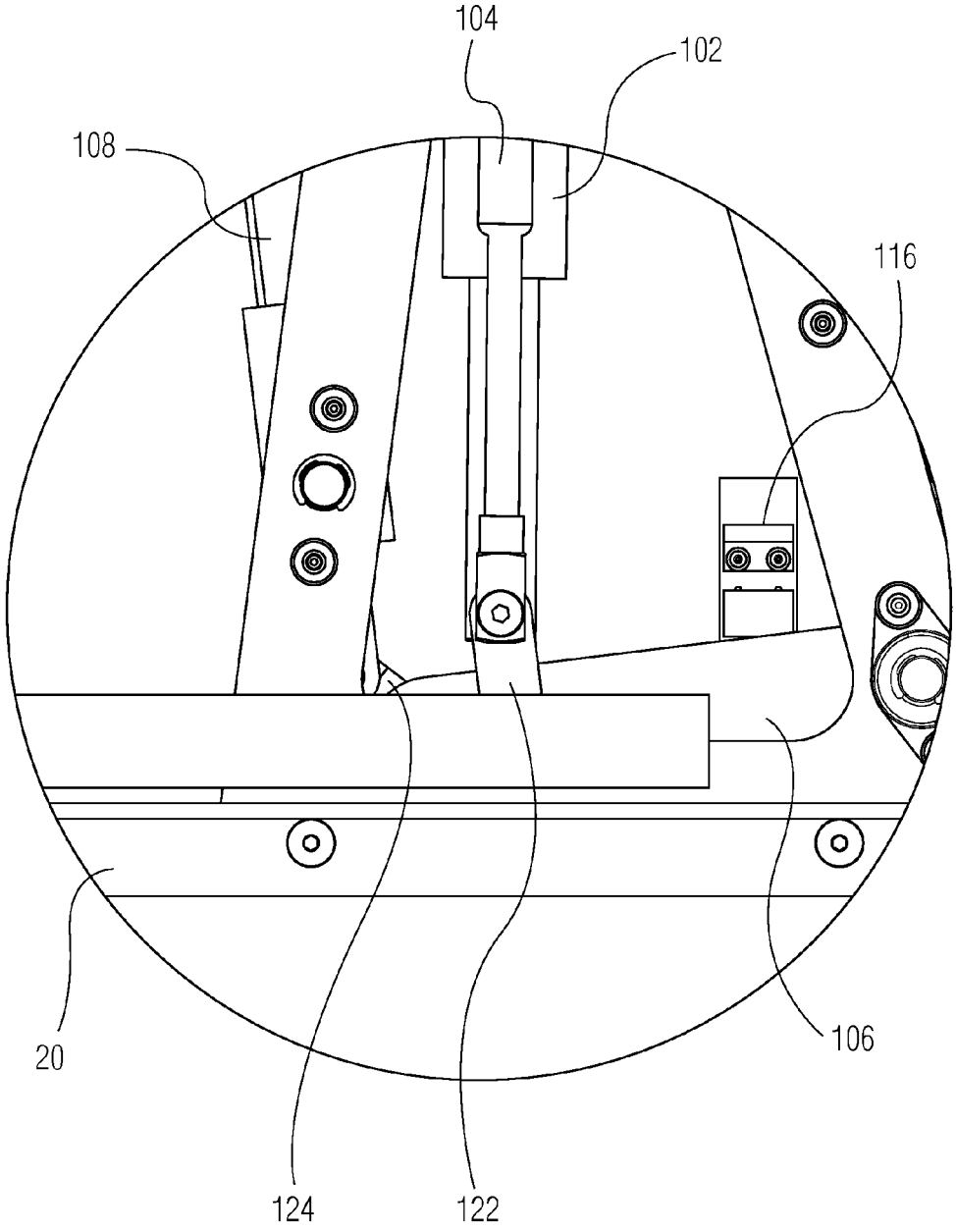
FIG. 5A shows a magnified view of a lifting mechanism according to an aspect of the present disclosure.
Figure 5B:
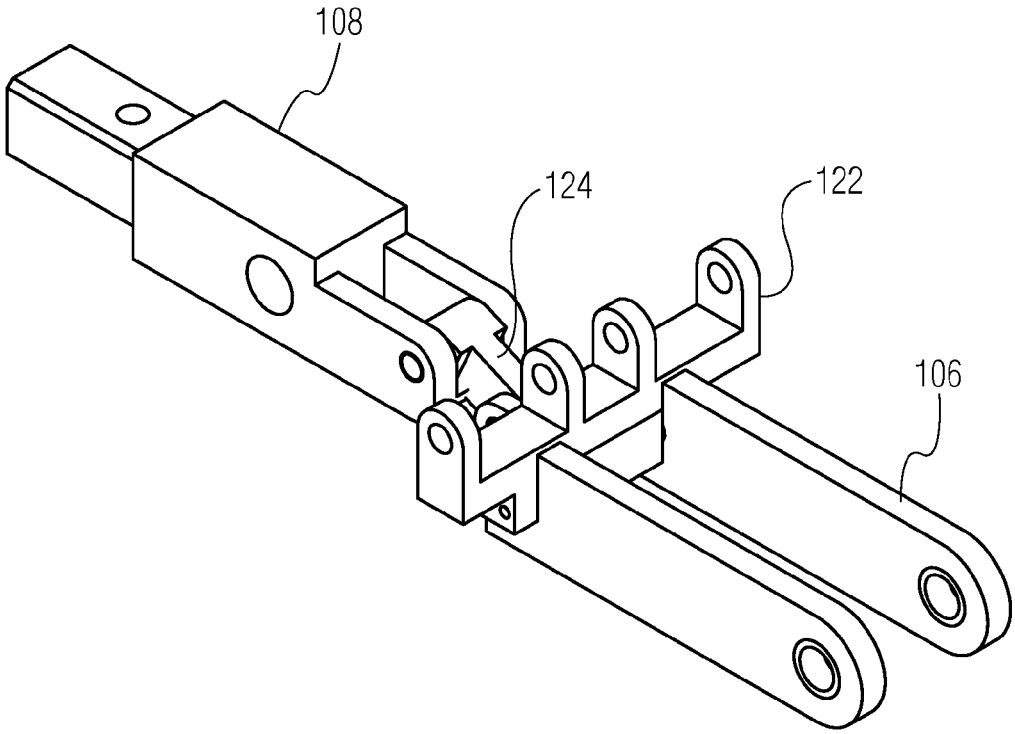
FIGS. 5B and 5C show perspective and side views of lever, link bar, intermediate link, and clevis according to an aspect of the present disclosure.
Figure 5C:
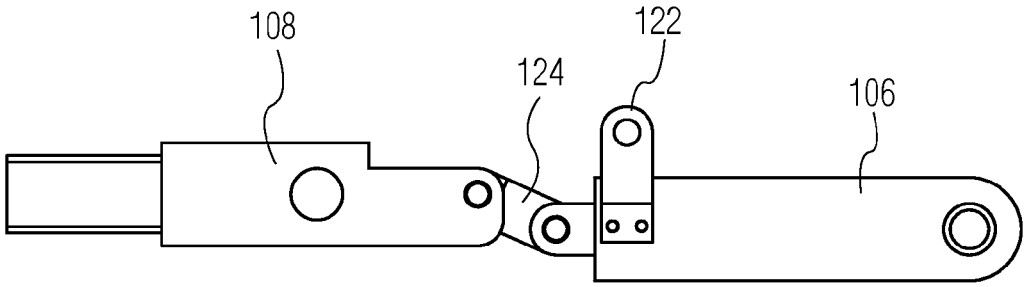
Figure 6C:
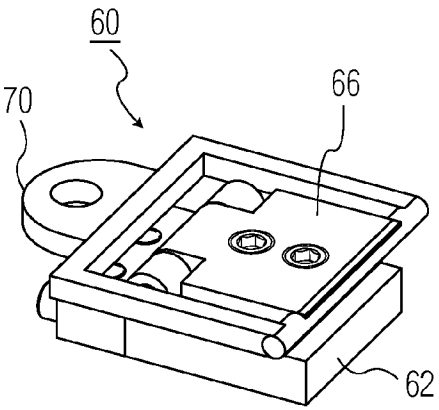
FIGS. 6A-6C and 7 show views of a release mechanism according to an aspect of the present disclosure.
Figure 6B:
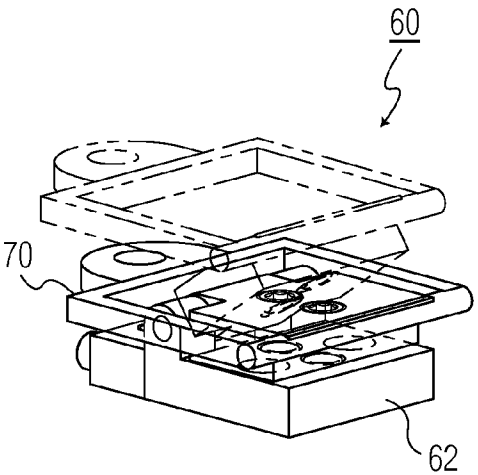
Figure 6A:
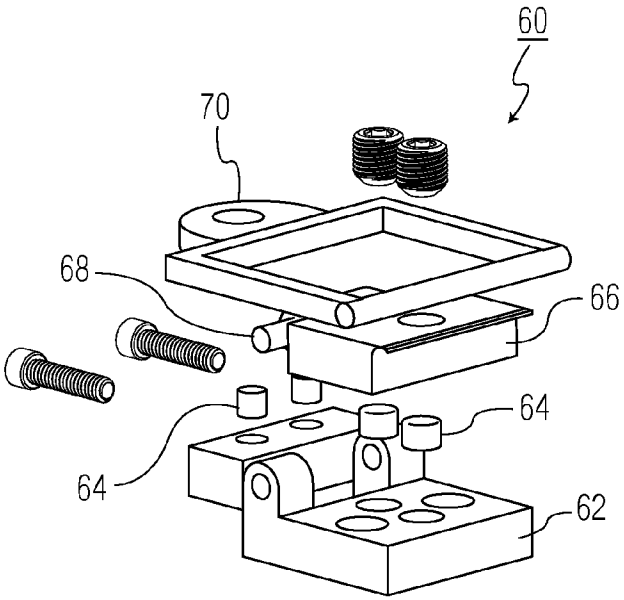

FIG. 5A shows a magnified view of lifting mechanism 22 in which part of frame 100 and part of lever 106 have been removed from view to better show sensor 116 and intermediate link 124. FIGS. 5B and 5C show perspective and side views of clevis 122 and lever 106 coupled to link bar 108 via intermediate link 124

Figure 10:
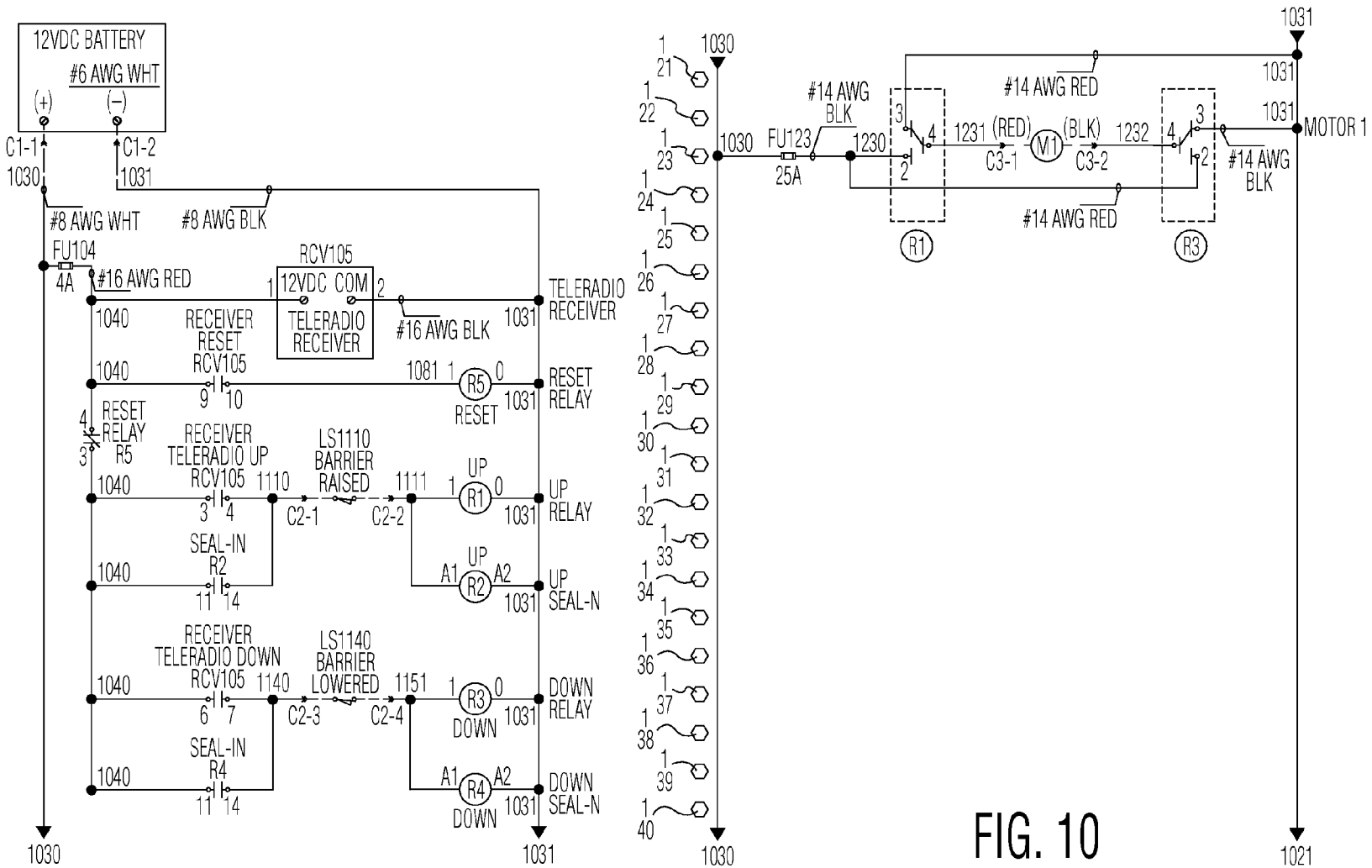
FIG. 10 shows an electrical control schematic according to an aspect of the present disclosure.

Returning to FIGS. 4A and 4B, control electronics 112 and sensor 116 may control raising and lowering of lifting arm 24. Control electronics 112 may receive wired or wireless signal instructions to control actuator 102 to raise or lower lifting arm 24. In one aspect, sensor 116 may be a magnetic sensor and may sense the proximity of one or more magnets (not shown) placed on lever 106. In other aspects, sensor 116 may be a proximity sensor or an infrared, optical, acoustic, capacitive, inductive, or other type of sensor. Sensor 116 and control electronics 112 may be electrically coupled and may deactivate actuator 102 when lifting arm 24 has reached desired raised or lowered position. Deactivating actuator 102 when lifting arm 24 has reached the desired position may prevent damaging the motor within actuator 102. In another aspect, sensors 116 may be placed on either side of or between levers 106 and each lever 106 may have a magnet attached thereto. In that aspect, one sensor 116 may act as an "up" sensor, and the other sensor 116 may act as the "down" sensor. Schematics for control electronics 112 and sensor 116 are shown in FIG. 10 according to one aspect of the system of the present disclosure. In another aspect, control electronics may include a microprocessor, I/O interface, and memory, including volatile and non-volatile memory in which control software may be stored. The system may be activated, controlled, and monitored, for example via a wired or wireless remote control. The system may be battery powered or may be powered via AC.

Figure 11:
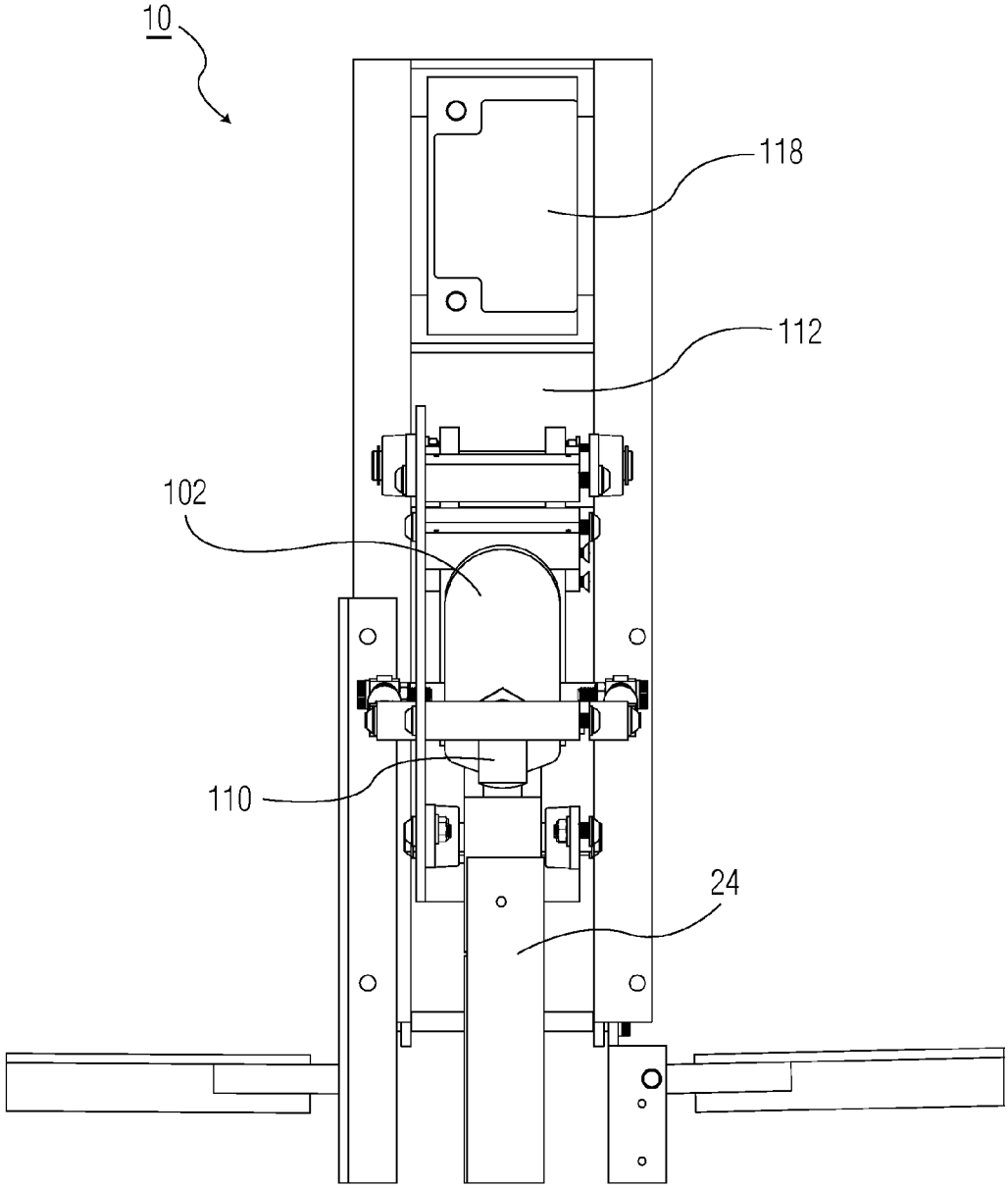
FIGS. 11 and 12 show views of a pillar according to an aspect of the present disclosure.
Figure 12:
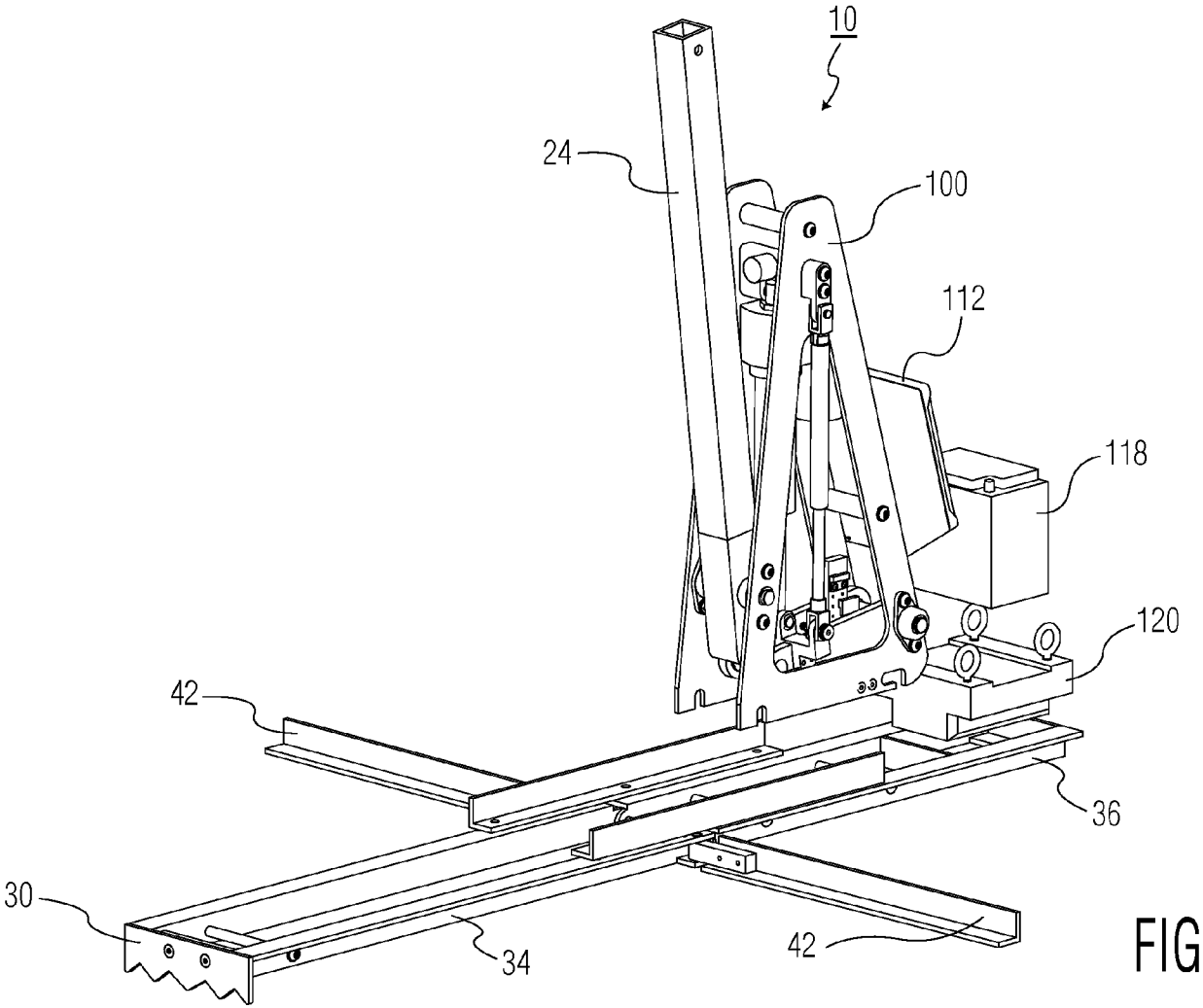

FIG. 11 shows a top view of pillar 10 with lifting arm 24 in an intermediate position. FIG. 12 shows a partially exploded perspective view of pillar 10 with lifting arm in an intermediate position.

Figure 7:
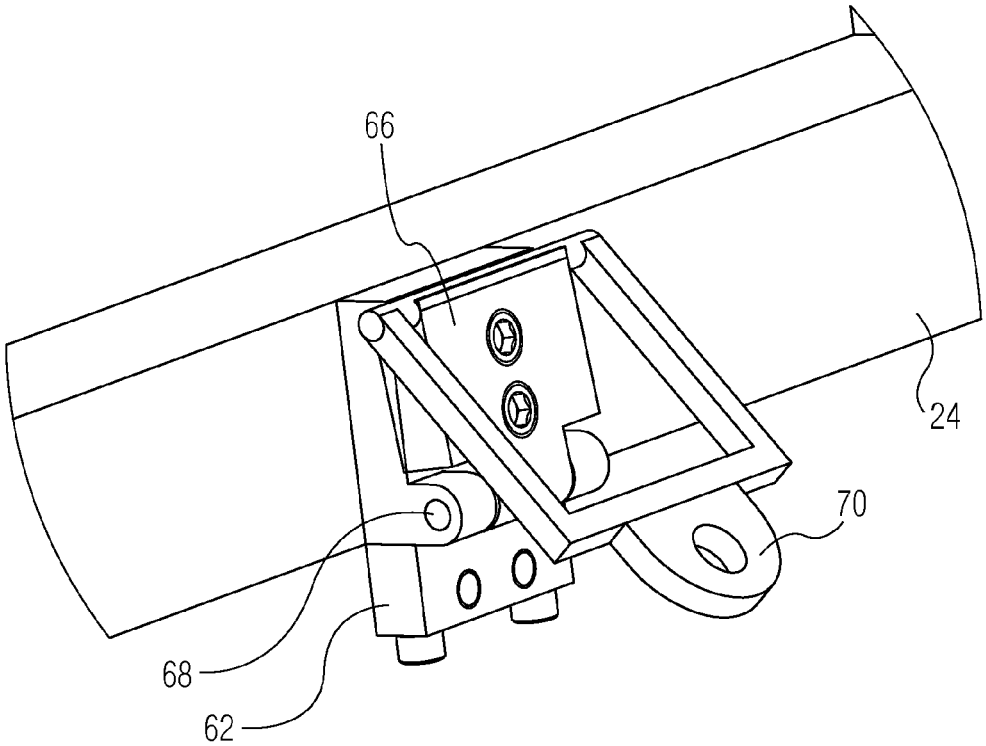

FIGS. 6A-6C and 7 show perspective and exploded views of a release mechanism 60 according to an aspect of the invention of the present disclosure. Base 62 may have magnets 64 embedded therein to facilitate connection with handle 70. Pivot release 66 may be connected to base 62 via pivot shaft 68. Handle 70 may be attached to pillar connector 208 (not shown) and may couple at least partially between base 62 and pivot release 66. Upon application of threshold force to net 6, pillar connector 208 may exert force on handle 70 causing pivot release 66 to rotate on pivot shaft 68 and release handle 70, thereby decoupling handle 70 from base 62 and lifting arm 24. FIG. 7 shows base 62 attached to lifting arm 24 and handle 70 in place. In one aspect, release mechanism 60 may be coupled to and arranged on lifting arm 24 facing a direction of travel of an errant vehicle. Release mechanism 60 may be made of metal, such as steel or aluminum.

Figure 8A:
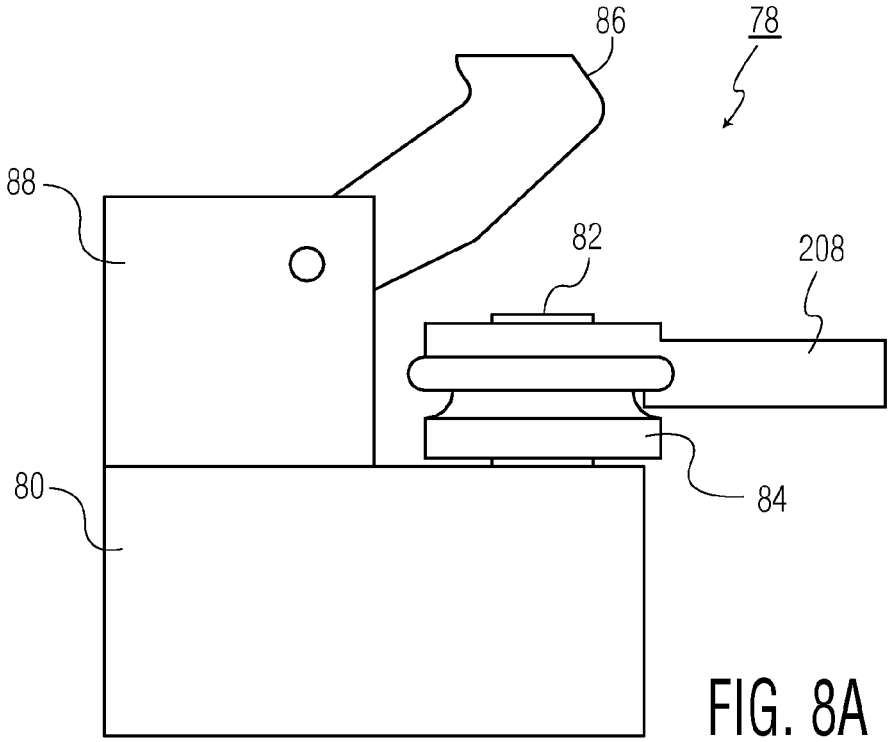
FIGS. 8A, 8B, 9A, and 9B show views of a second release mechanism according to an aspect of the present disclosure.
Figure 8B:
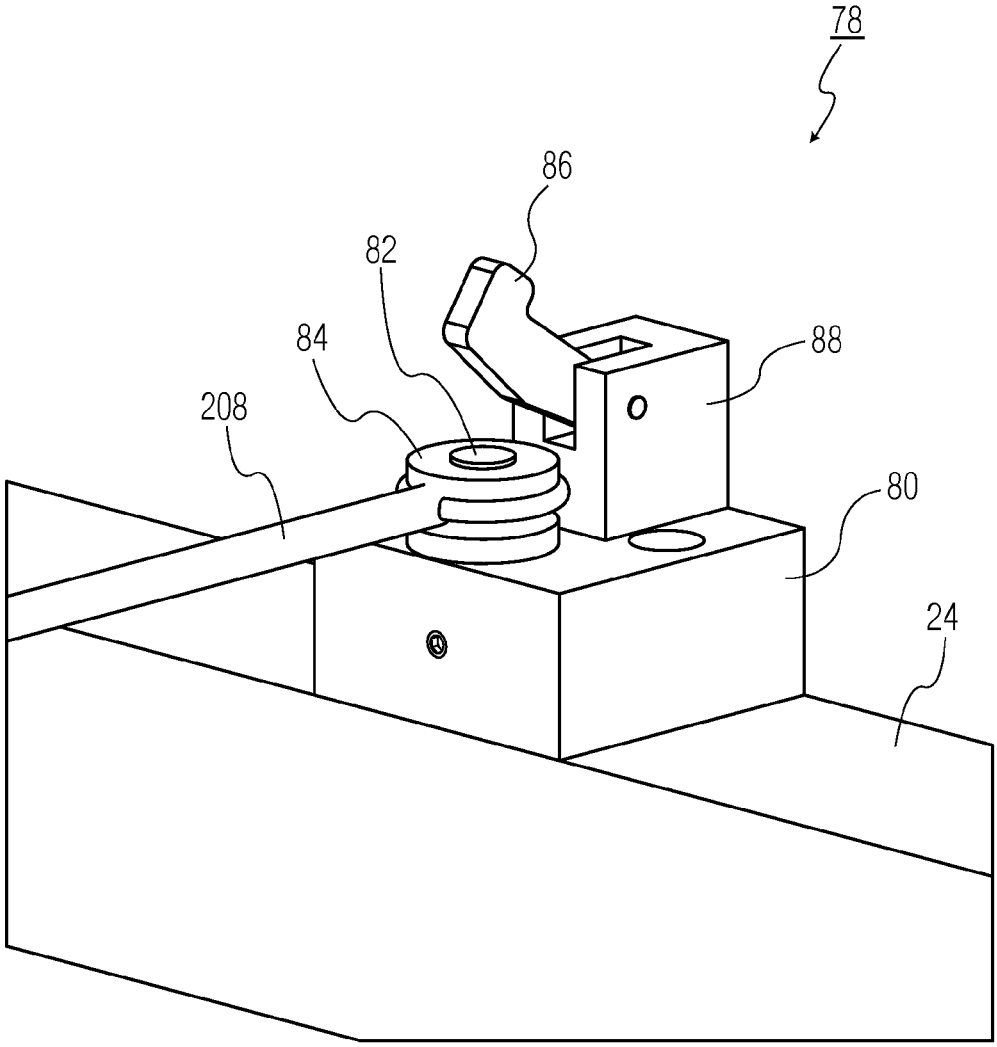

FIGS. 8A, 8B, 9A and 9B show views of release mechanism 78 according to another aspect of the invention of the present disclosure. FIG. 8A shows a top view with handle 84 on post 82 and arm 86 in an open position as would be the case when assembling or resetting the release mechanism 78. Post 82 may be attached to base 80. Handle 84 may be attached to pillar connector 208 and may slide onto post 82 and may be held in place by arm 86 when in a closed position. Arm 86 may be hingably coupled to extension 88 mounted on base 80 and may be spring-loaded and set at a predetermined tension to move from a closed position to an open position, such as upon application of a threshold force to net 6, for example, that provided by contact of net 6 by a moving vehicle. Upon application of threshold force to net 6, pillar connector 208 and handle 84 may move in a direction away from base 80 causing arm 86 to open, thereby permitting handle 84 to move off post 82 and decouple from lifting arm 24. FIG. 8B shows a perspective view of release mechanism 78 mounted on lifting arm 24, where arm 86 is in an open position and handle 84 is on post 82. In one aspect, release mechanism 78 may be arranged on lifting arm 24 facing a direction of travel of an errant vehicle.

Figure 9A:
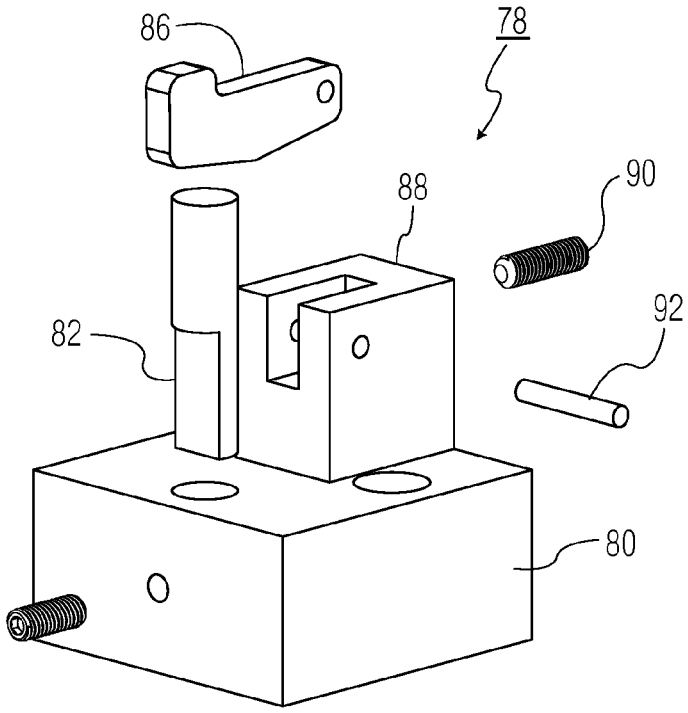
Figure 9B:
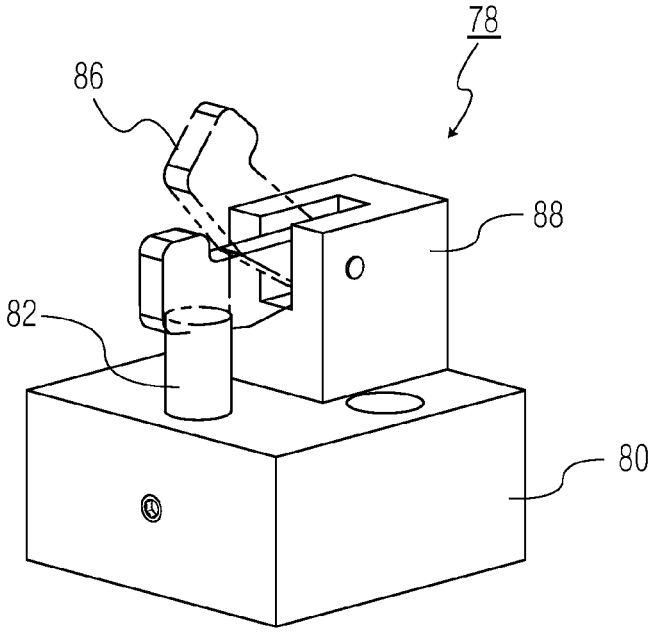

FIG. 9A shows an exploded perspective view of release mechanism 78 with spring detent pin 90 and pivot pin 92. FIG. 9B shows a perspective view of release mechanism 78 highlighting open and closed positions of arm 86.

Figure 13A:
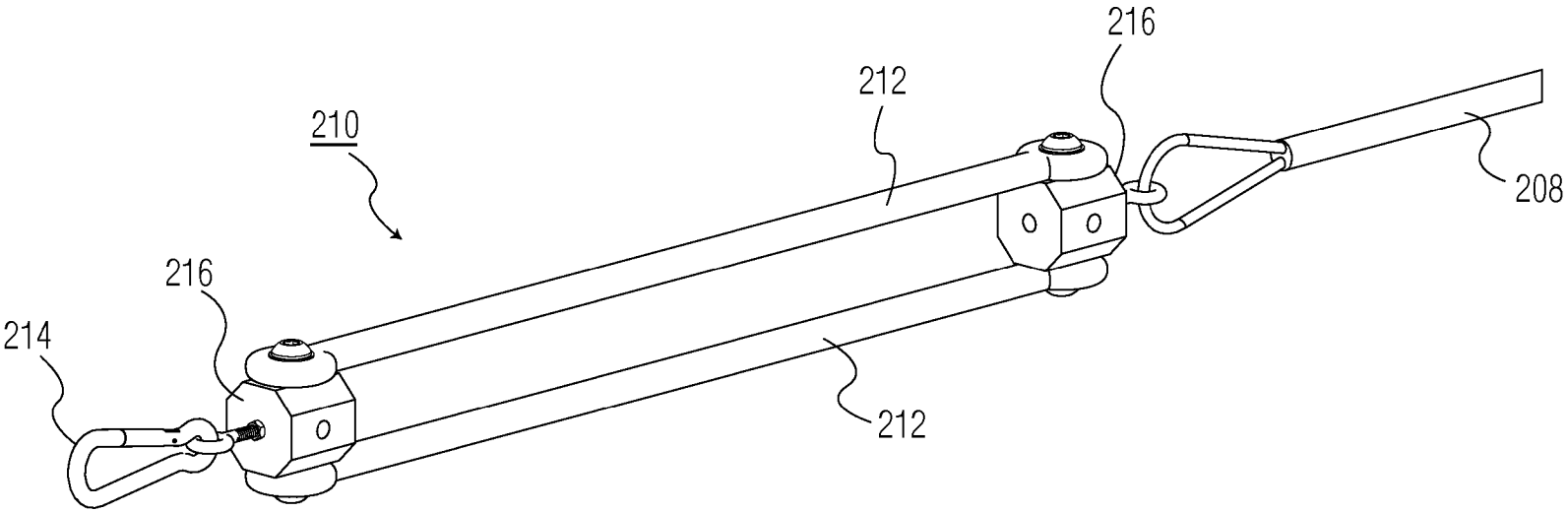
FIGS. 13A and 13B show views of a coupler assembly according to an aspect of the present disclosure.
Figure 13B:
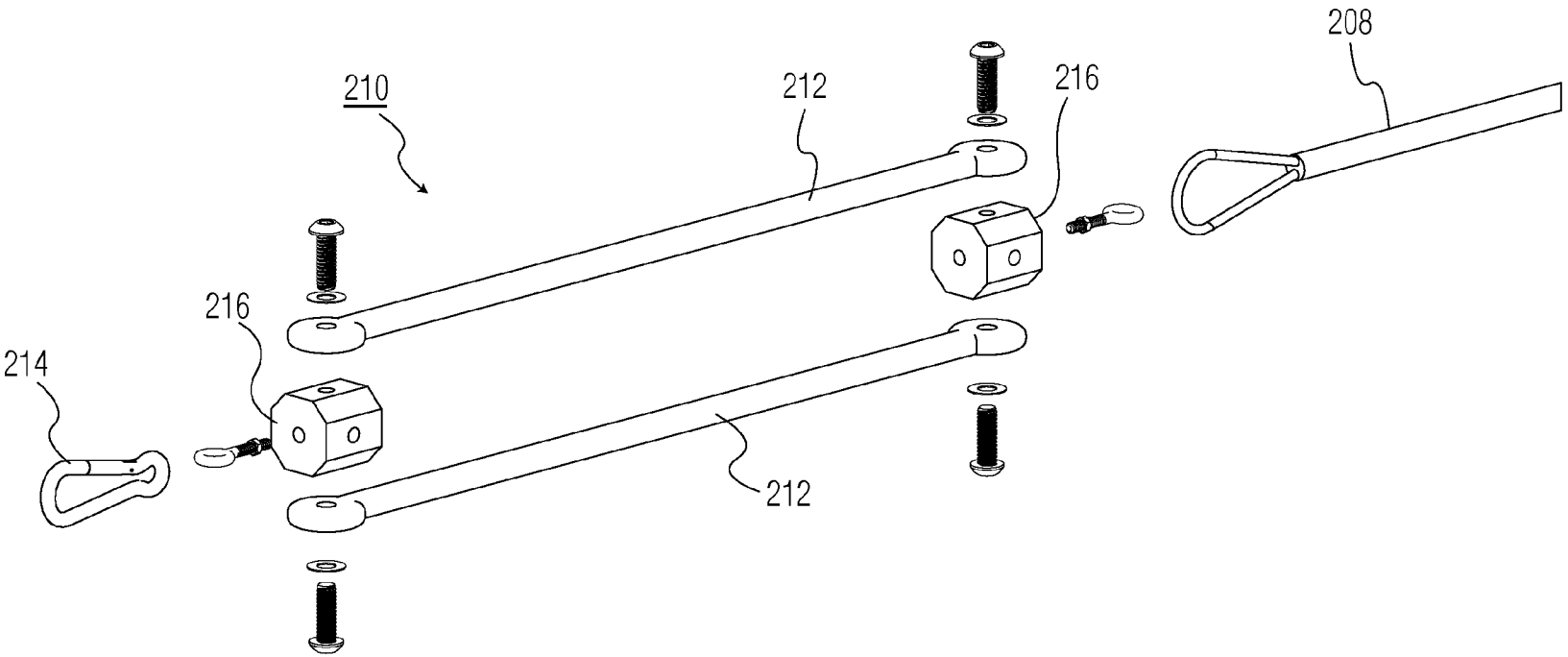

FIGS. 13A and 13B show perspective and exploded perspective views of a coupler assembly 210 that may couple and allow flexible connection between net 6 and pillar connector 208. In one aspect, coupler assembly 210 may include one or more flexible or elastic connectors 212, clips 214, and spacers 216.

Figure 14A:
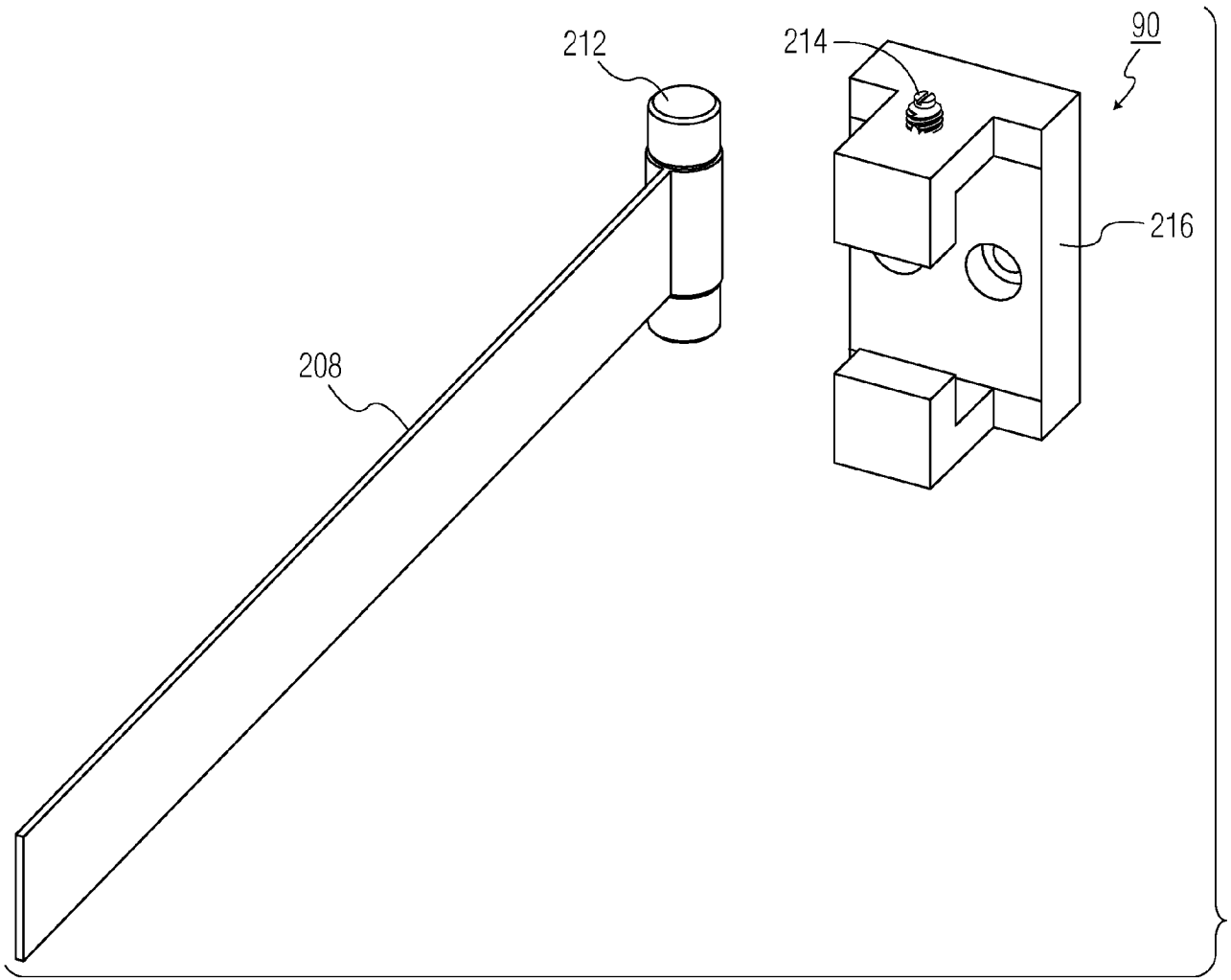
FIGS. 14A-14C show views of a third release mechanism according to an aspect of the present disclosure.
Figure 14B:
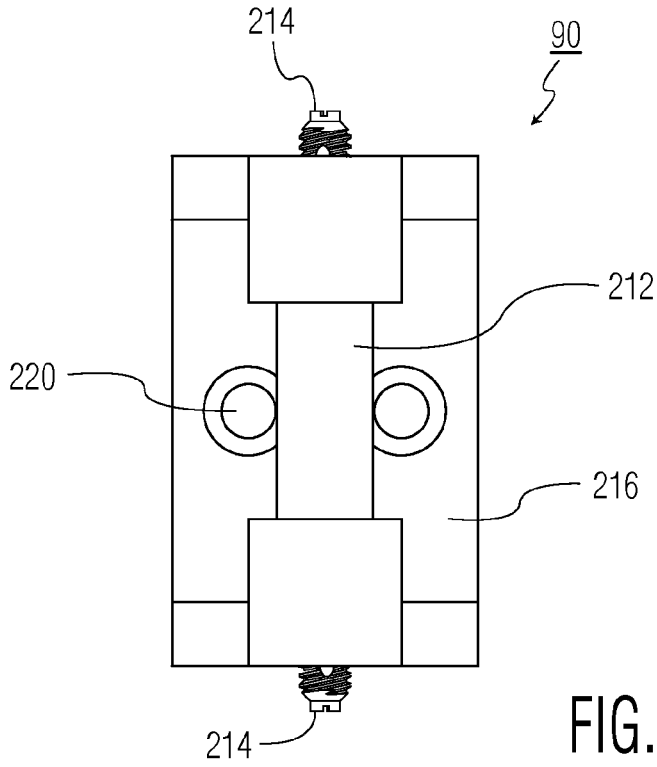
Figure 14C:
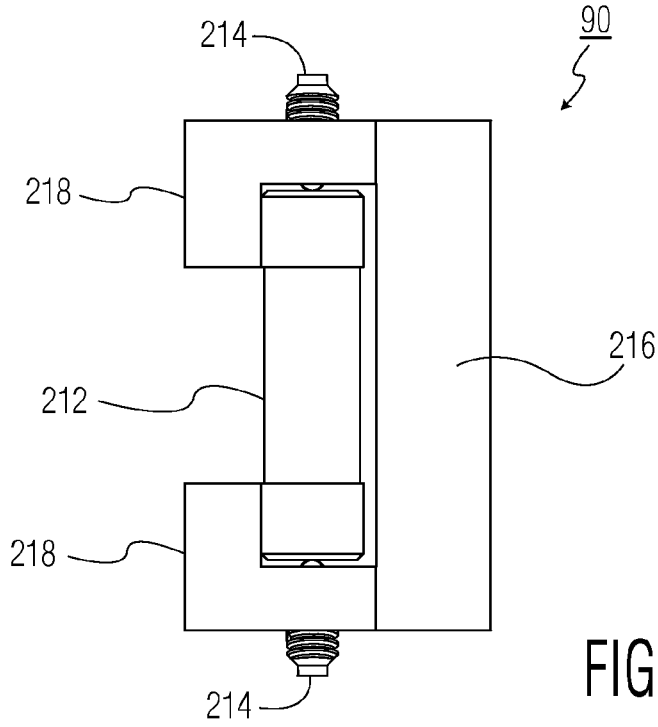

FIGS. 14A, 14B, and 14C show views of release mechanism 90 according to an aspect of the system of the present disclosure. Release mechanism 90 may include release mechanism base 216 that may be attached to lifting arm 24 (not shown). FIG. 14A shows perspective view of pillar connector 208 and pin 212, where pin 212 is decoupled and apart from release mechanism base 216. FIGS. 14B and 14C show front and side views respectively of release mechanism 90 in which pin 212 is secured to release mechanism base 216 with assistance of plungers 214 located at the top and bottom of release mechanism base 216. As shown in FIG. 14C, in one aspect, release mechanism base 216 may be "C"-shaped and may have upper and lower extensions 218 that may include lips that may assist securing pin 212. Pillar connector 208 is not shown in FIGS. 14B and 14C for clarity.

In one aspect, plungers 214 may be plunger pins; however, it will be understood that other types of securing mechanisms may be used to assist securing pin 212 to release mechanism base 216. Plungers 214 may be selected or set at a predetermined tension in order to secure pin 212 in place during raising and lowering of net 6, and may allow pin 212 to decouple from release mechanism base 216, for example, upon application of a predetermined threshold force to pin 212 via pillar connector 208 and net 6. In one example, due to the design and arrangement of release mechanism 90, pin 212 may decouple from release mechanism base 216 when net 6 is struck by a moving vehicle approaching the barrier in either direction. Pin 212 may also decouple from release mechanism base 216 when plungers 214 are depressed, for example, during manual installation or service.

Movement of lifting arms 24 between raised and lowered positions (as shown in FIGS. 2A and 2B) and the weight of net 6 and pillar connector 208 may tend to encourage decoupling of pin 212 and release mechanism 90. In one aspect, release mechanism 90 and lifting arms 24 may arranged such that release mechanism bases 216 face each other across a roadway. The design and orientation of release mechanism 90, including plungers 214 and/or upper and lower extensions 218 may assist keeping pin 212 and pillar connector 208 coupled to release mechanism base 216 and lifting arm 24 during raising/lowering of lifting arm 24 and allow pin 212 to decouple when net 6 is struck by a vehicle.

Apertures 220 may allow release mechanism 90 to be attached to lifting arm 24 via bolt or other connector. Some or all of release mechanisms may be made of metal, such as steel or aluminum, and may be coated or painted to protect from damage.

Numerous additional modifications and variations of the present disclosure are possible in view of the above teachings. It is therefore to be understood that within the scope of the appended claims, the present disclosure may be practiced other than as specifically described herein.

The invention claimed is:

1. A barrier for arresting a vehicle, comprising:

a net spanning an area through which the vehicle may pass;

an anchor coupled to the net;

a support arm arranged on one side of the area through which the vehicle may pass;

a raising/lowering mechanism for raising and lowering the support arm; and a release mechanism arranged on the support arm, the release mechanism having an upper and a lower protrusion forming an interior space to accommodate a member coupled to the net, wherein the member and the release mechanism are configured to uncouple upon application to the net of at least a predetermined threshold force.

2. The barrier according to claim 1, wherein the release mechanism further comprises at least one securing pin in contact with the member.

3. The barrier according to claim 1, wherein the release mechanism further comprises at least one of an upper and a lower securing pin in contact with the member.

4. The barrier according to claim 1, wherein the upper and lower protrusions each include a lip to secure the member.

5. The barrier according to claim 1, wherein the support arm is lowered in a direction perpendicular to the direction of travel of the vehicle.

6. The barrier according to claim 1, wherein the release mechanism faces the area through which the vehicle may pass.

7. The barrier according to claim 1, wherein the upper and lower protrusions form an aperture through which an extension couples the member to the net.

8. The barrier according to claim 1, wherein the predetermined threshold force is the force provided by impact by the vehicle with the net.

9. The barrier according to claim 1, where the release mechanism is substantially 'C'-shaped.

10. The barrier according to claim 1, where the member is a cylinder.

11. The barrier according to claim 1, further comprising an energy absorber between the net and the anchor, wherein the energy absorber is configured to decelerate the vehicle when the vehicle engages the net.

* * * * *